US011136987B2

(12) United States Patent
Chang et al.

(10) Patent No.: US 11,136,987 B2
(45) Date of Patent: Oct. 5, 2021

(54) SERIES-CONNECTED FAN

(71) Applicant: DELTA ELECTRONICS, INC., Taoyuan (TW)

(72) Inventors: Shun-Chen Chang, Taoyuan Hsien (TW); Po-Cheng Kung, Taoyuan Hsien (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 81 days.

(21) Appl. No.: 16/591,917

(22) Filed: Oct. 3, 2019

(65) Prior Publication Data

US 2020/0217322 A1 Jul. 9, 2020

(30) Foreign Application Priority Data

Jan. 4, 2019 (CN) ..... 201910008364.7

(51) Int. Cl.
*F04D 19/00* (2006.01)
*F04D 29/52* (2006.01)
*F04D 29/38* (2006.01)

(52) U.S. Cl.
CPC ..... *F04D 19/007* (2013.01); *F04D 19/002* (2013.01); *F04D 29/386* (2013.01); *F04D 29/522* (2013.01)

(58) Field of Classification Search
CPC .... F04D 19/002; F04D 19/007; F04D 19/024; F04D 25/0613; F04D 29/386; F04D 29/522; F04D 29/646; F04D 29/622; F04D 29/325; F04D 29/384; F04D 29/542; F04D 29/544
See application file for complete search history.

(56) References Cited

U.S. PATENT DOCUMENTS 4,909,711 A * 3/1990 Burgbacher ..... F04D 25/08 415/218.1
6,935,843 B2 * 8/2005 Wang ..... F04D 29/281 415/218.1
7,872,381 B2 * 1/2011 Watanabe ..... F04D 19/007 310/58

(Continued)

OTHER PUBLICATIONS

Larson et al—Calculus early transcendental functions p. 881. Houghton Mifflin Boston, MA ISBN 0-395-93320-X (Year: 1999).*

*Primary Examiner* — Patrick Hamo
*Assistant Examiner* — Joseph S. Herrmann
(74) *Attorney, Agent, or Firm* — Muncy, Geissler, Olds & Lowe, P.C.

(57) ABSTRACT

A series-connected fan includes a first fan and a second fan. The first fan includes a first frame, a first base, first static blades and a first impeller. The second fan includes a second frame, a second base, second static blades and a second impeller. A first underframe of the first frame is connected to a second underframe of the second frame. The first static blades are disposed around the first base and connected to the first base and the first underframe. The second static blades are disposed around the second base and connected to the second base and the second underframe. The first impeller includes a first hub and first rotor blades. The second impeller includes a second hub and second rotor blades. The cross-sectional area of the first hub increases along a direction from the top of the first hub to the bottom of the first hub.

17 Claims, 4 Drawing Sheets

(56) References Cited

U.S. PATENT DOCUMENTS

| | | | | |
|---|---|---|---|---|
| 8,360,735 | B2 * | 1/2013 | Hanaoka | F04D 19/007 417/2 |
| 8,668,477 | B2 * | 3/2014 | Wu | F04D 19/007 417/423.5 |
| 8,678,785 | B2 * | 3/2014 | Nogami | F04D 25/0613 417/410.1 |
| 9,568,008 | B2 * | 2/2017 | Huang | F04D 25/0613 |
| 2008/0101920 | A1 | 5/2008 | Yoshida et al. | |
| 2017/0239603 | A1 | 8/2017 | Lin | |

* cited by examiner

SERIES-CONNECTED FAN

CROSS REFERENCE TO RELATED APPLICATIONS

This Non-provisional application claims priority under 35 U.S.C. § 119(a) on Patent Application No(s). 201910008364.7 filed in People's Republic of China on Jan. 4, 2019, the entire contents of which are hereby incorporated by reference.

BACKGROUND OF THE DISCLOSURE

Field of Disclosure

The present disclosure relates to a series-connected fan and, in particular, to a mixed-flow type series-connected contra-rotating fan.

RELATED ART

As the performance of electronic devices continuously increases, the current electronic devices generate a large amount of waste heat during operation. If the heat cannot be immediately removed from the electronic device, the temperature of the electronic device will rise, thereby causing damage to internal components and reducing the performance and lifetime of the electronic device. In particular, the large-scale electronic devices used for big data calculations are more likely to cause a large amount of high-temperature waste heat due to their large amount of calculations. Fans are widely used to dissipate the heat generated by electronic devices. Currently, those skilled in the art have developed a series-connected fan comprising two axial-flow fans that rotate in opposite directions to increase the wind pressure of the fan, thereby increasing the heat dissipation efficiency of the large-scale electronics.

However, the axial-flow fan has the characteristics of high air quantity and low back pressure resistance. Therefore, in the series-connected contra-rotating fan, since the front fan and the rear fan both have the characteristics of high air quantity, a high back pressure can be generated inside the front fan, thereby reducing the efficiency of the front fan and causing extra energy loss. Accordingly, the front fan and the rear fan of the series-connected contra-rotating fan cannot achieve the optimum performance, thereby increasing the power consumption of the series-connected contra-rotating fan.

Therefore, it is desired to provide a series-connected contra-rotating fan that can avoid the extra energy loss caused by the high back pressure of the front fan so as to increase the operation performance of the front fan, thereby improving the operation performance of the series-connected contra-rotating fan and decreasing the power consumption thereof.

SUMMARY OF THE DISCLOSURE

An objective of this disclosure is to provide a series-connected fan that can avoid the extra energy loss caused by the high back pressure of the front fan so as to increase the operation performance of the front fan, thereby improving the operation performance of the series-connected contra-rotating fan and decreasing the power consumption thereof.

The disclosure provides a series-connected fan, which comprises a first fan and a second fan. The first fan comprises a first frame, a first base, a plurality of first static blades, and a first impeller. The first frame comprises a first underframe. The first base is disposed in the first frame. The first static blades are disposed around a periphery of the first base and connected to the first base and the first underframe. The first impeller is connected to the first base and disposed in the first frame. The first impeller comprises a first hub and a plurality of first rotor blades. A cross-sectional area of the first hub increases along a direction from a top portion of the first hub to a bottom portion of the first hub. The first rotor blades are disposed around a periphery of the first hub. The second fan comprises a second frame, a second base, a plurality of second static blades, and a second impeller. The second frame comprises a second underframe, and the second underframe is connected to the first underframe of the first frame. The second base is disposed in the second frame. The second static blades are disposed around a periphery of the second base and connected to the second base and the second underframe. The second impeller is connected to the second base and disposed in the second frame. The second impeller comprises a second hub and a plurality of second rotor blades. The second rotor blades are disposed around a periphery of the second hub.

In one embodiment, the first static blades are disposed adjacent to the second static blades and connected each other.

In one embodiment, the first impeller and the second impeller are rotated coaxially along an axis.

In one embodiment, a radius of the first hub gradually increases along a direction from the top portion of the first hub to the bottom portion of the first hub. In addition, an outer periphery of the first hub comprises a curved portion, and an included angle between the axis and a tangent line of any point on the curved portion of the outer periphery is 0~30 degrees.

In one embodiment, an outer periphery of the first hub comprises a curved portion, a first tangent line is defined on a start point of the curved portion of the outer periphery, a second tangent line is defined on an end point of the curved portion of the outer periphery, and an included angle between the axis and the second tangent line is greater than an included angle between the axis and the first tangent line.

In one embodiment, an included angle between the first tangent line and the second tangent line is 3~20 degrees.

In one embodiment, an inner periphery of the first hub is gradually expanded. That is, the radius of the inner periphery of the first hub gradually increases along a direction from the top portion of the first hub to the bottom portion of the first hub. In addition, the inner periphery of the first hub comprises a curved portion, and an included angle between the axis and a tangent line of any point on the curved portion of the inner periphery is 0~30 degrees.

In one embodiment, an inner periphery of the first hub comprises a curved portion, a third tangent line is defined on a start point of the curved portion of the inner periphery, a fourth tangent line is defined on an end point of the curved portion of the inner periphery, and an included angle between the axis and the fourth tangent line is greater than an included angle between the axis and the third tangent line.

In one embodiment, an included angle between the third tangent line and the fourth tangent line is 3~20 degrees.

In one embodiment, an inlet area is defined between a top portion of the first frame and the top portion of the first hub, an outlet area is defined between a bottom portion of the first frame and the bottom portion of the first hub, and a ratio of the inlet area to the outlet area ranges from 0.9 to 1.1.

In one embodiment, the edges of the first rotor blades disposed adjacent to the first base have a V-shape structure.

In one embodiment, a ratio of a minimum distance between the edges of the first rotor blades disposed adjacent to the first base to a maximum distance between the edges of the first rotor blades disposed adjacent to the first base ranges from 0.1 to 0.8.

In one embodiment, the first rotor blades have a wing structure.

In one embodiment, the first base is disposed adjacent to the second base, and the first base and the second base form an accommodating space.

In one embodiment, the first base has a first extension portion, the second base has a second extension portion, the first extension portion and the second extension portion extend axially, and the first extension portion is connected with the second extension portion to form the accommodating space.

In one embodiment, the series-connected fan further comprises a first circuit board disposed between the first base and the first impeller, the first base comprises an opening, and an electronic element is installed on the first circuit board and extends through the opening to the accommodating space.

In one embodiment, the series-connected fan further comprises a second circuit board disposed between the second base and the second impeller, the second base comprises an opening, and an electronic element is installed on the second circuit board and extends through the opening to the accommodating space.

In one embodiment, a rotation direction of the first impeller is opposite to a rotation direction of the second impeller.

In one embodiment, the top portion of the first hub has at least a balance hole.

As mentioned above, in the series-connected fan of this disclosure, the first impeller of the first fan has a mixed-flow design, the first rotor blades have a V-shape structure, and the inner periphery of the first frame is gradually expanded, so that the pressure of the airflow induced by the first fan can be increased so as to improve the air pressure of the first fan. In addition, the back pressure resistance of the first fan can be increased due to the mixed-flow design. Moreover, the contra-rotating design can improve the entire heat-dissipation efficiency. Compared with the conventional series-connected fan, the series-connected fan of this disclosure can increase the operation performance of the first fan, thereby improving the operation performance of the series-connected fan and decreasing the power consumption thereof.

BRIEF DESCRIPTION OF THE DRAWINGS

The present disclosure will become more fully understood from the subsequent detailed description and accompanying drawings, which are given by way of illustration only, and thus are not limitative of the present disclosure, and wherein.

DETAILED DESCRIPTION OF THE DISCLOSURE

The present disclosure will be apparent from the following detailed description, which proceeds with reference to the accompanying drawings, wherein the same references relate to the same elements.

The series-connected fan of this disclosure can increase the operation performance of the first fan, thereby improving the operation performance of the series-connected fan and decreasing the power consumption thereof. The structure and features of the series-connected fan of this disclosure will be described in the following embodiment.

Figure 1:
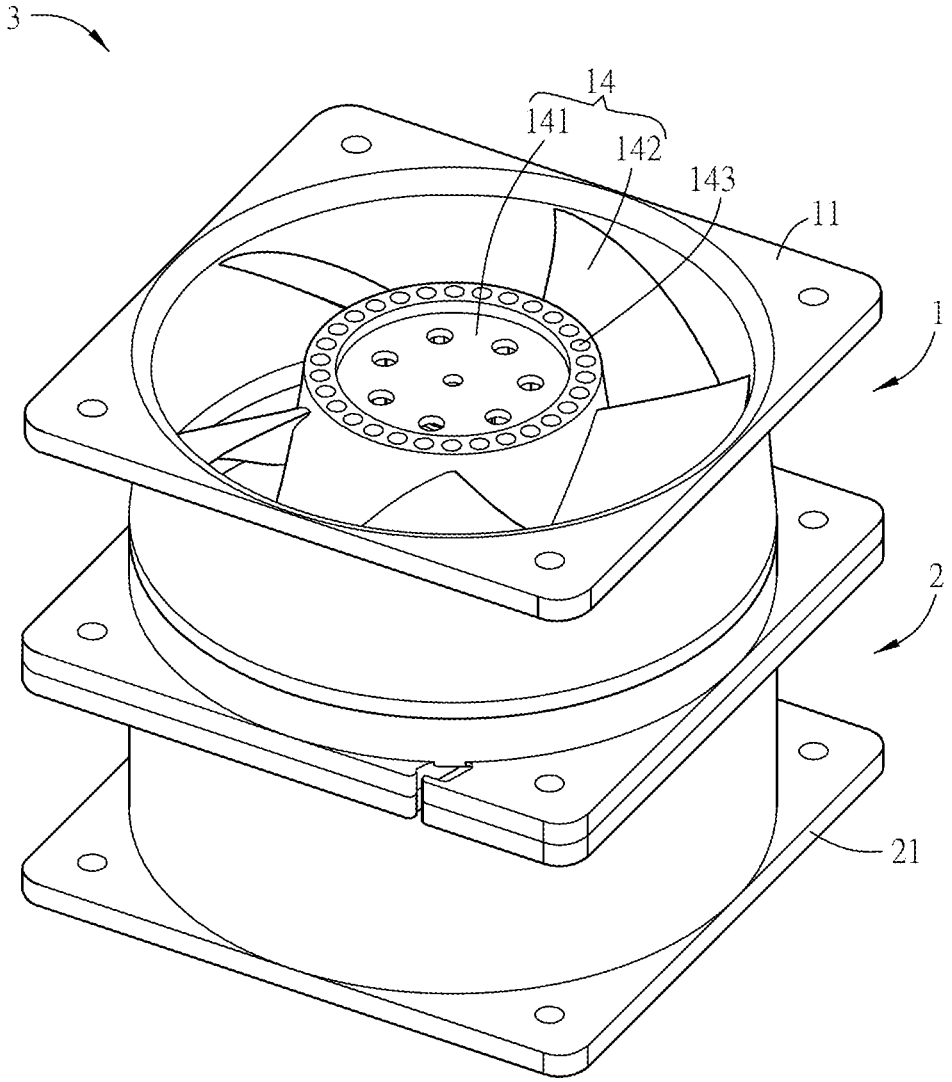
FIG. 1 is a schematic diagram showing a series-connected fan according to an embodiment of this disclosure.
Figure 2:
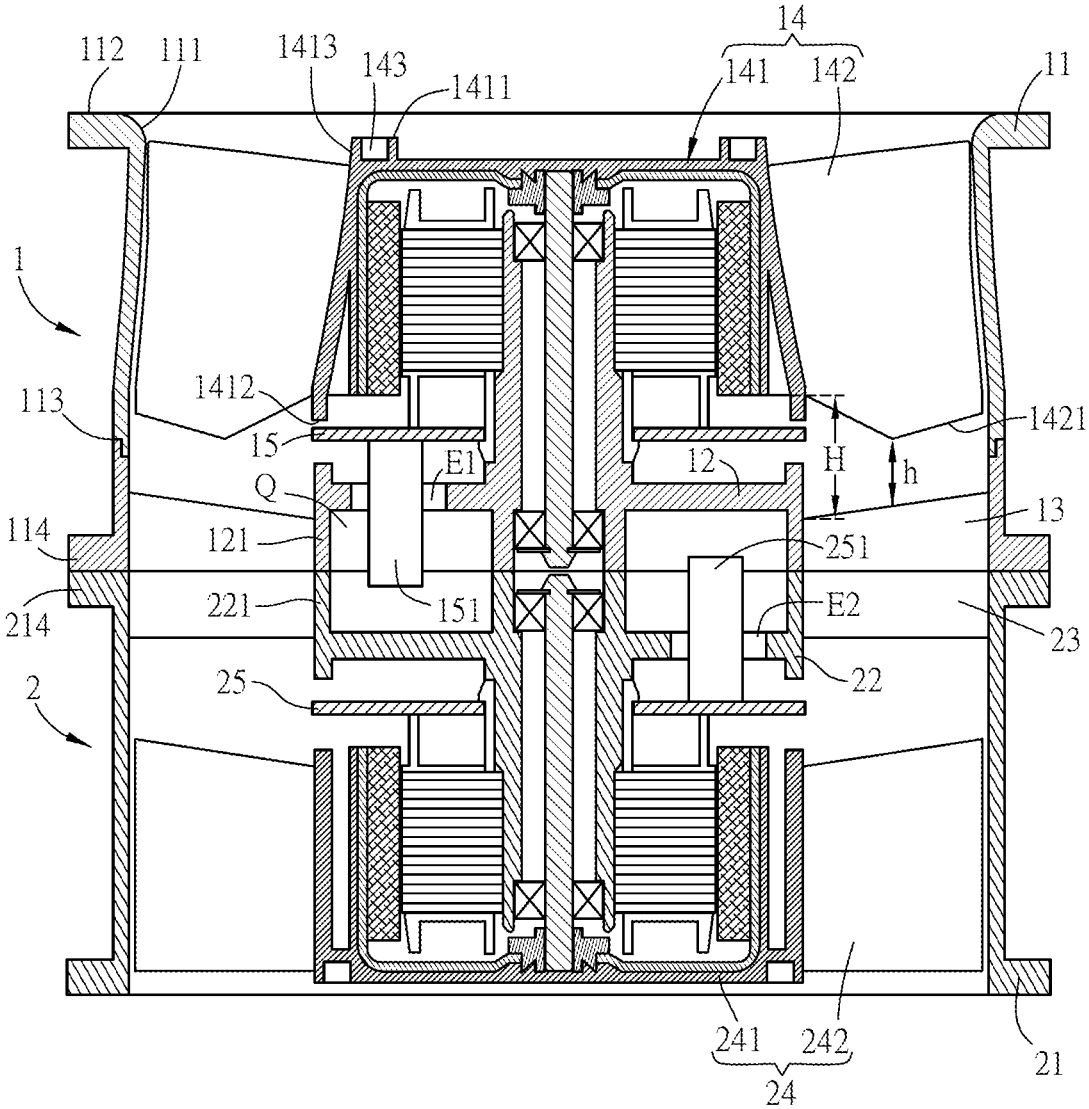
FIG. 2 is a sectional view of the series-connected fan of FIG. 1.

FIG. 1 is a schematic diagram showing a series-connected fan according to an embodiment of this disclosure, and FIG. 2 is a sectional view of the series-connected fan of FIG. 1. As shown in FIGS. 1 and 2, the series-connected fan 3 comprises a first fan 1 and a second fan 2. The first fan 1 comprises a first frame 11, a first base 12, a plurality of first static blades 13, and a first impeller 14. The first frame 11 comprises a first underframe 114. The first base 12 is disposed in the first frame 11. The first static blades 13 are disposed around a periphery of the first base 12 and connected to the first base 12 and the first underframe 114 of the first frame 11. The first impeller 14 is connected to the first base 12 and disposed in the first frame 11. The first impeller 14 comprises a first hub 141 and a plurality of first rotor blades 142. A cross-sectional area of the first hub 141 increases along a direction from a top portion 1411 of the first hub 141 to a bottom portion 1412 of the first hub 141. The first rotor blades 142 are disposed around a periphery of the first hub 141.

The second fan 2 comprises a second frame 21, a second base 22, a plurality of second static blades 23, and a second impeller 24. The second frame 21 comprises a second underframe 214, and the second underframe 214 is connected to the first underframe 114 of the first frame 11. The second base 22 is disposed in the second frame 21. The second static blades 23 are disposed around a periphery of the second base 22 and connected to the second base 22 and the second underframe 214 of the second frame 21. The second impeller 24 is connected to the second base 22 and disposed in the second frame 21. The second impeller 24 comprises a second hub 241 and a plurality of second rotor blades 242. The second rotor blades 242 are disposed around a periphery of the second hub 241. Specifically, the second frame 21 is connected with the first frame 11 in series, and the first static blades 13 are disposed adjacent to the second static blades 23 and connected each other.

In this embodiment, each of the first static blades 13 and the second static blades 23 can have a wing shape or not. Those skilled persons in the art can easily modify the aspect thereof, and this disclosure is not limited thereto.

Figure 3:
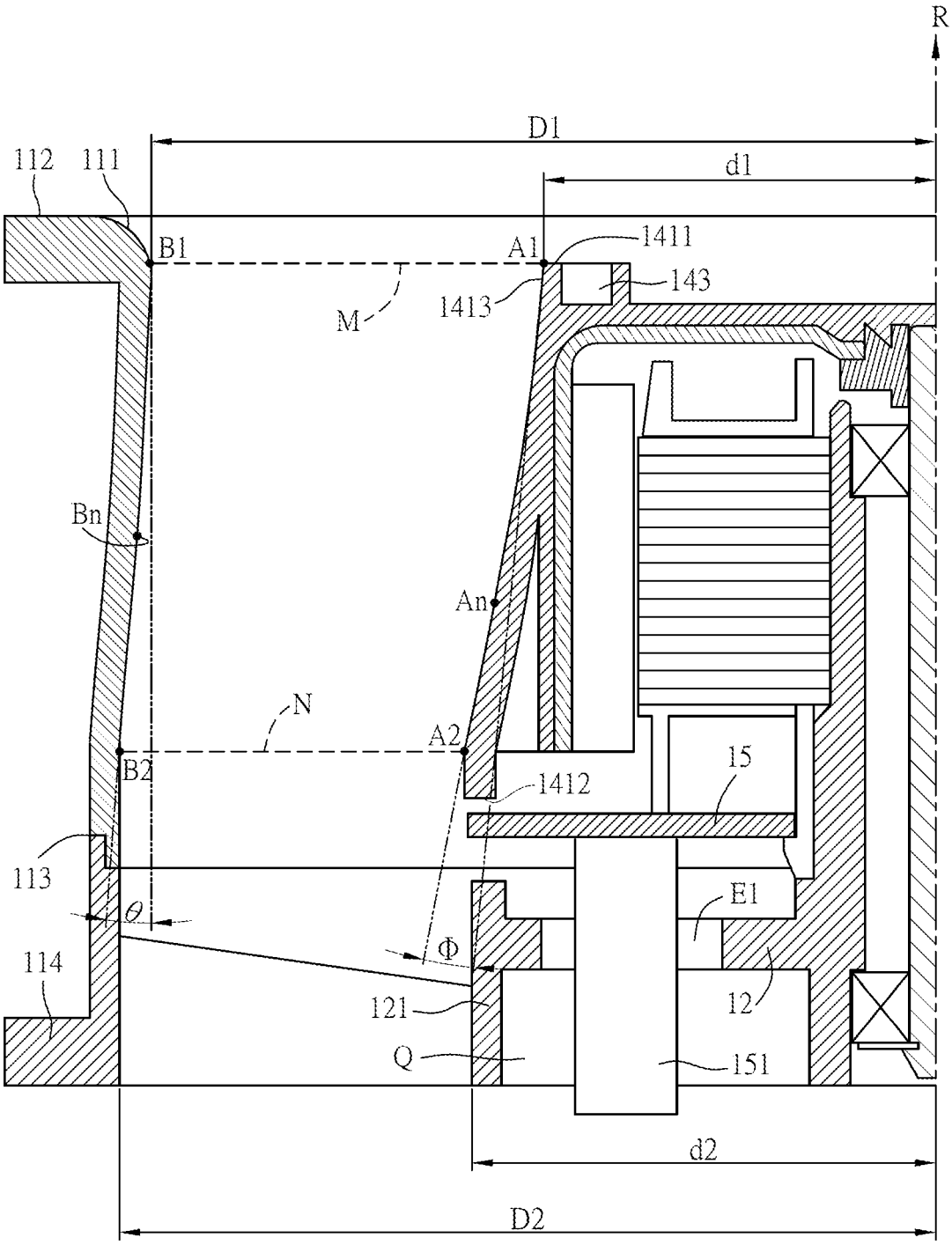
FIG. 3 is a partial enlarged diagram of the first fan of the series-connected fan of FIG. 2.

FIG. 3 is a partial enlarged diagram of the first fan of the series-connected fan of FIG. 2. FIG. 3 is a sectional view of the first fan passing through the axis R. Referring to FIGS. 2 and 3, in this embodiment, the first impeller 14 and the second impeller 24 can rotate coaxially along the same axis R. The radius of the first hub 141 gradually increases along a direction from the top portion 1411 of the first hub 141 to the bottom portion 1412 of the first hub 141. In addition, an outer periphery of the first hub 141 comprises a curved portion. A first tangent line is defined on a start point A1 of the curved portion of the outer periphery disposed adjacent to the top portion 1411, and a first included angle between the axis R and the first tangent line is 0~30 degrees. A second tangent line is defined on an end point A2 of the curved portion of the outer periphery disposed adjacent to the bottom portion 1412, and a second included angle between the axis R and the second tangent line is greater than the first included angle. The second included angle is 0~30 degrees. An included angle Θ between the first and second tangent lines is 3~20 degrees. That is, the curvature of the outer periphery of the first hub 141 gradually increases along the direction from the top portion 1411 of the first hub 141 to the bottom portion 1412 of the first hub 141.

In this embodiment, an included angle between the axis R and a tangent line of any point An on the curved portion of the outer periphery of the first hub 141 is 0~30 degrees.

In addition, a radius of the first hub 141 close to the top portion 1411 is d1, and a radius of the first hub 141 close to the bottom portion 1412 is d2. The radius of the first hub 141 gradually increases along the direction from the top portion 1411 of the first hub 141 to the bottom portion 1412 of the first hub 141 (d2>d1).

Referring to FIGS. 2 and 3, the radius of the inner periphery 111 of the first frame 11 gradually increases along a direction from the top portion 112 of the first frame 11 to the bottom portion 113 of the first frame 11. In other words, the inner periphery 111 of the first frame 11 is gradually expanded and comprises a curved portion. A third tangent line is defined on a start point B1 of the curved portion of the inner periphery 111 of the first frame 11 disposed adjacent to the top portion 112, and a third included angle between the third tangent line and the axis R is 0~30 degrees. A fourth tangent line is defined on an end point B2 of the curved portion of the inner periphery 111 of the first frame 11 disposed adjacent to the bottom portion 113, and a fourth included angle between the axis R and the fourth tangent line is greater than the third included angle. The fourth included angle is 0~30 degrees. An included angle Θ between the third and fourth tangent lines is 3~20 degrees. That is, the curvature of the inner periphery 111 of the first frame 11 gradually increases along the direction from the top portion 112 to the bottom portion 113. Accordingly, the inner periphery 111 of the first frame 11 has a gradual-expanded design.

In this embodiment, an included angle between the axis R and a tangent line of any point Bn on the curved portion of the inner periphery 111 of the first frame 11 is 0~30 degrees.

In addition, a radius of the inner periphery 111 of the first frame 11 close to the top portion 112 is D1, and a radius of the inner periphery 111 of the first frame 11 close to the bottom portion 113 is D2. The radius of the inner periphery 111 of the first frame 11 gradually increases along the direction from the top portion 112 of the first frame 11 to the bottom portion 113 of the first frame 11 (D2>D1).

In this embodiment, the included angle Φ of the first hub 141 and the included angle Θ of the first frame can be the same or different. As mentioned above, the cross-sectional area and the curvature of the first hub 141 of the first fan 1 gradually increases along the direction from the top portion 1411 of the first hub 141 to the bottom portion 1412 of the first hub 141. Accordingly, the airflow distance can be increased based on the gradual-expanded design of the first frame 11 and the mixed-flow design of the first hub 141, thereby increasing the air pressure of the first fan 1 and thus decreasing the power consumption of the series-connected fan 3.

In this embodiment, an inlet area M is defined between the top portion 112 of the first frame 11 and the top portion 1411 of the first hub 141, and an outlet area N is defined between the bottom portion 113 of the first frame 11 and the bottom portion 1412 of the first hub 141. A ratio of the inlet area M to the outlet area N ranges from 0.9 to 1.1. For example, the inlet area M can be calculated by subscribing the circle defined by the radius D1 of the top portion 112 of the first frame 11 with the circle defined by the radius d1 of the top portion 1411 of the first hub 141. The inlet area M can be the effective area of the inlet of first fan 1 that allows the air to enter the first fan 1. The inlet area M of the first frame 11 can be calculated by the following equation: $M=(D1^2-d1^2)\pi/4$. In addition, the outlet area N can be calculated by subscribing the circle defined by the radius of the bottom portion 113 of the first frame 11 with the circle defined by the radius of the bottom portion 1412 of the first hub 141. The outlet area N can be the effective area of the outlet of first fan 1 that allows the air to exit the first fan 1. The outlet area N of the first frame 11 can be calculated by the following equation: $N=(D2^2-d2^2)\pi/4$. Preferably, the ratio of the inlet area M to the outlet area N ranges from 0.9 to 1.1. Preferably, the ratio of the inlet area M to the outlet area N is 1. In other words, the ratio of the inlet area M and the outlet area N of a main flow channel, which is defined between the first frame 11 and the first hub 141, ranges from 0.9 to 1.1.

In this embodiment, the edges 1421 of the first rotor blades 142 disposed adjacent to the first base 12 have a V-shape structure. For example, the edge 1421 of each first rotor blade 142 disposed adjacent to the first base 12 can be partially cut to form a V-shape structure. To be noted, although this embodiment discloses that the edges 1421 of the first rotor blades 142 disposed adjacent to the first base 12 have a V-shape structure, the edges 1421 can also be formed with any other suitable shape that can provide different distances between the edges 1421 and the first base 12.

In this embodiment, a ratio of a minimum distance h between the edges 1421 of the first rotor blades 142 disposed adjacent to the first base 12 to a maximum distance H between the edges 1421 of the first rotor blades 142 disposed adjacent to the first base 12 ranges from 0.1 to 0.8. In this case, the distances between the first base 12 and the edges of the first rotor blades 142 are different, and the ratio of the minimum distance h therebetween and the maximum distance H therebetween ranges from 0.1 to 0.8. This configuration can decrease the noise generated by the first fan 1. To be noted, FIG. 2 shows that the minimum distance h and the maximum distance H are the distances between the edges 1421 and the first static blades 13. In other embodiments, the minimum distance h and the maximum distance H can be the distances between the edges 1421 and the first base 12. In other embodiments, the minimum distance h and the maximum distance H can be the distances between the radial planes of the edges 1421 and the first base 12. In this embodiment, the ratio of the minimum distance h and the maximum distance H ranges from 0.1 to 0.8. Preferably, the ratio of the minimum distance h and the maximum distance H ranges from 0.4 to 0.5.

Figure 4:
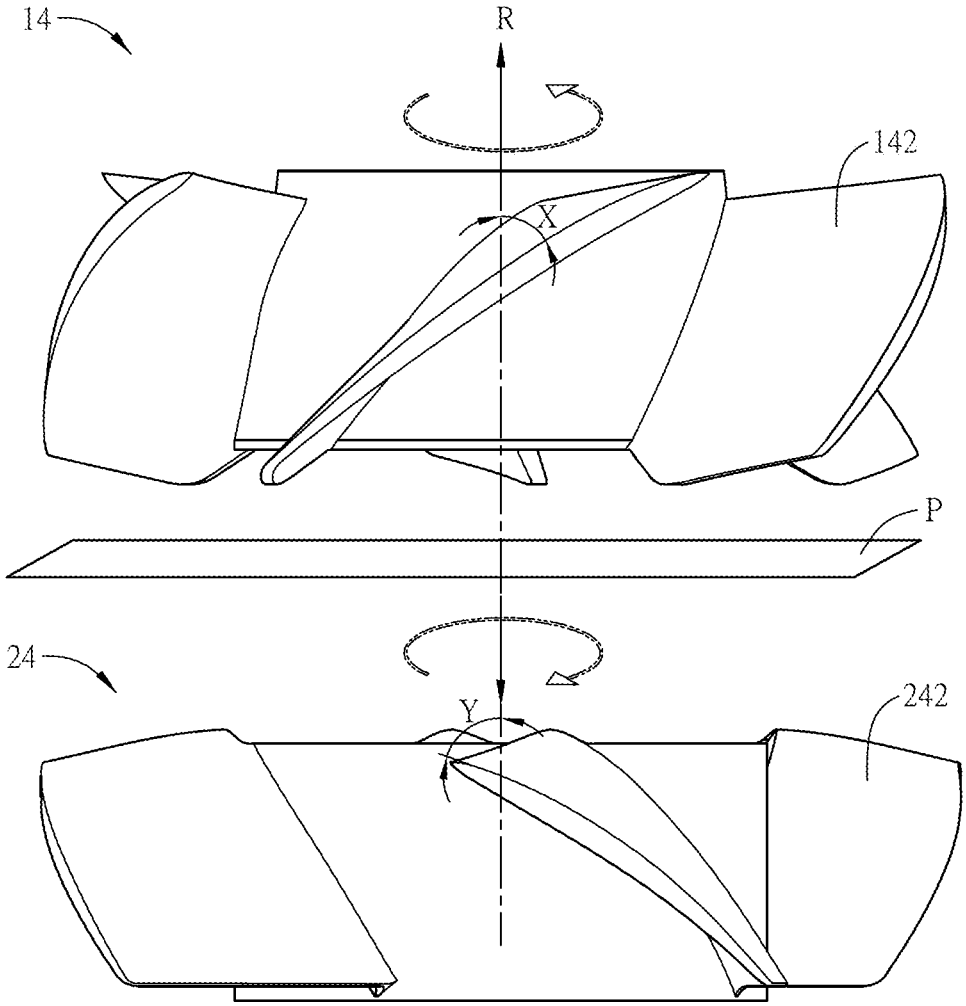
FIG. 4 is a side view of the first impeller and the second impeller of the series-connected fan of FIG. 2.

As shown in FIG. 4, in this embodiment, the first rotor blades 142 have a wing structure. In practice, the cross-section of each of the first rotor blades 142 has a non-uniform thickness. To be noted, FIG. 4 shows that the second rotor blades 242 also have a wing structure. In other embodiments, the second rotor blades 242 can have a plate structure or any of other structures, and this disclosure is not limited. The wing structure design of the first rotor blades 142 can increase the airflow inside the first fan 1 for enhancing the heat-dissipation efficiency.

In this embodiment, a first rotor-blade included angle X is defined between the first rotor blades 142 and the axis R of the series-connected fan 3, and a second rotor-blade included angle Y is defined between the second rotor blades 242 and the axis R of the series-connected fan 3. With relative to the axis R, the first rotor-blade included angle X ranges from +20 degrees to +80 degrees, and the second rotor-blade included angle Y ranges from −20 degrees to −80 degrees. That is, the first rotor blades 142 and the second rotor blades 242 have opposite configuration directions with relative to the axis R of the series-connected fan 3. In other words, with respective to a mirror plane P, which is defined on the radial direction of the axis R of the series-connected fan 3 between the first impeller 14 and the second impeller 24, the extension direction of the first rotor blades 142 is opposite to the extension direction of the second rotor blades 242. That is, the extension directions are in mirror symmetry. In this embodiment, the amount of the first rotor blades 142 and the amount of the second rotor blades 242 can be the same or different, and any configuration of the first rotor blades 142 and the second rotor blades 242 having opposite configuration directions with respective to the axis R of the series-connected fan 3 is acceptable. Preferably, with relative to the axis R, the first rotor-blade included angle X ranges from +20 degrees to +80 degrees, and the second rotor-blade included angle Y ranges from −20 degrees to −80 degrees. Preferably, with relative to the axis R, the first rotor-blade included angle X ranges from +40 degrees to +70 degrees, and the second rotor-blade included angle Y ranges from −40 degrees to −70 degrees.

Referring to FIGS. 2 and 3, in this embodiment, the first base 12 is disposed adjacent to the second base 22, and the first base 12 and the second base 22 form an accommodating space Q. Compared with the conventional base, the first base 12 has a first extension portion 121, and the second base 22 has a second extension portion 221. The first extension portion 121 and the second extension portion 221 extend axially, and the first extension portion 121 is connected with the second extension portion 221 to form the accommodating space Q. The size of the accommodating space Q is defined by the first extension portion 121 and the second extension portion 221. In practice, the accommodating space Q can be used to receive the electronic elements of the first fan 1 and the second fan 2. As shown in FIG. 2, the first fan 1 further comprises a circuit board 15 disposed between the first base 12 and the first impeller 14. For the sake of high power requirement, the circuit board 15 needs to carry the electronic element 151 with larger volume. In addition, the first base 12 further comprises an opening E1, and the electronic element 151 installed on the circuit board 15 can extend through the opening E1 and reach the accommodating space Q. In general, the electronic element 151 is a capacitor, but this disclosure is not limited thereto. Similarly, the second fan 2 further comprises a circuit board 25 disposed between the second base 22 and the second impeller 24. In addition, the second base 22 further comprises an opening E2, and the electronic element 251 installed on the circuit board 25 can extend through the opening E2 and reach the accommodating space Q. For the sake of high power requirement, the accommodating space Q can be configured to receive a large-size electronic element, thereby reducing the entire height of the series-connected fan 3.

As shown in FIG. 4, in this embodiment, the rotation direction of the first impeller 14 is opposite to the rotation direction of the second impeller 24. In other words, the rotation direction of the first fan 1 is opposite to the rotation direction of the second fan 2. That is, the first and second fans 1, 2 can be assembled to form a contra-rotating fan. This design can increase the air quantity inside the first and second fans 1, 2, thereby increasing the heat-dissipation efficiency of the first and second fans 1, 2.

Referring to FIGS. 1 and 2 again, the top portion of the first hub 141 of the first fan 1 has at least a balance hole 143. When the weight of the first fan 1 is not balance, which can result in the unbalance rotation, it is possible to fill the balance hole 143 with a balance member (e.g. clay) to calibrate the weight of the first fan 1. Accordingly, the first fan 1 can achieve a balance rotation.

In summary, the series-connected fan 3 of this disclosure comprises a first fan 1 and a second fan 2. A cross-sectional area of the first hub 141 of the first fan 1 increases along a direction from a top portion 1411 of the first hub 141 to a bottom portion 1412 of the first hub 141. The curvature of the first frame 11 gradually increases along the direction from the top portion 112 of the first frame 11 to the bottom portion 113 of the first frame 11. The edges 1421 of the first rotor blades 142 of the first fan 1 disposed adjacent to the first base 12 have a V-shape structure, and the first rotor blades 142 of the first fan 1 has a wing structure. According to the mixed-flow design of the first hub 141, the gradual-expanded design of the first frame 11, and the shape design of the edges 1421 of the first rotor blades 142, the air pressure of the first fan 1 can be increased so as to enhance the operation performance of the first fan 1, and the noise and power consumption of the series-connected fan 3 can also be decreased. In addition, the accommodating space Q is formed between the first base 12 and the second base 22 for accommodating the larger electronic elements on the circuit boards of the first and second fans 1, 2. This configuration can reduce the total height of the series-connected fan 3. Moreover, the first fan 1 and the second fan 2 have a contra-rotating fan design, which can provide a better heat-dissipation efficiency.

Although the present disclosure has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the present disclosure.

What is claimed is:

1. A series-connected fan, comprising:

a first fan comprising:

a first frame comprising a first underframe;

a first base disposed in the first frame;

a plurality of first static blades disposed around a periphery of the first base and connected to the first base and the first underframe; and a first impeller connected to the first base and disposed in the first frame, wherein the first impeller comprises a first hub and a plurality of first rotor blades, the first rotor blades are disposed around a periphery of the first hub, and a cross-sectional area of the first hub increases along a direction from a top portion of the first hub to a bottom portion of the first hub; and a second fan comprising:

a second frame comprising a second underframe, wherein the second underframe is connected to the first underframe of the first frame;

a second base disposed in the second frame;

a plurality of second static blades disposed around a periphery of the second base and connected to the second base and the second underframe; and a second impeller connected to the second base and disposed in the second frame, wherein the second impeller comprises a second hub and a plurality of second rotor blades, and the second rotor blades are disposed around a periphery of the second hub, wherein edges of the first rotor blades disposed adjacent to the first base have a V-shape structure, and wherein a ratio of a minimum distance between the edges of the first rotor blades disposed adjacent to the first base to a maximum distance between the edges of the first rotor blades disposed adjacent to the first base ranges from 0.1 to 0.8.

2. The series-connected fan according to claim 1, wherein the first static blades are disposed adjacent to the second static blades and are connected to each other.

3. The series-connected fan according to claim 1, wherein the first rotor blades have a wing structure.

4. The series-connected fan according to claim 1, wherein an inlet area is defined between a top portion of the first frame and the top portion of the first hub, an outlet area is defined between a bottom portion of the first frame and the bottom portion of the first hub, and a ratio of the inlet area to the outlet area ranges from 0.9 to 1.1.

5. The series-connected fan according to claim 1, wherein the top portion of the first hub has at least a balance hole.

6. The series-connected fan according to claim 1, wherein the first base is disposed adjacent to the second base, and the first base and the second base form an accommodating space.

7. The series-connected fan according to claim 6, wherein the first base has a first extension portion, the second base has a second extension portion, the first extension portion and the second extension portion extend axially, and the first extension portion is connected with the second extension portion to form the accommodating space.

8. The series-connected fan according to claim 6, further comprising a first circuit board disposed between the first base and the first impeller, wherein the first base comprises an opening, and an electronic element is installed on the first circuit board and extends through the opening to the accommodating space.

9. The series-connected fan according to claim 6, further comprising a second circuit board disposed between the second base and the second impeller, wherein the second base comprises an opening, and an electronic element is installed on the second circuit board and extends through the opening to the accommodating space.

10. The series-connected fan according to claim 1, wherein the first impeller and the second impeller are rotated coaxially along an axis.

11. The series-connected fan according to claim 10, wherein an outer periphery of the first hub comprises a curved portion, and an included angle between the axis and a tangent line of any point on the curved portion of the outer periphery in a plane containing the axis is between 0 degrees and 30 degrees.

12. The series-connected fan according to claim 10, wherein an outer periphery of the first hub comprises a curved portion, a first tangent line is defined on a start point of the curved portion of the outer periphery in a plane containing the axis, a second tangent line is defined on an end point of the curved portion of the outer periphery in the plane containing the axis, and an included angle between the axis and the second tangent line is greater than an included angle between the axis and the first tangent line.

13. The series-connected fan according to claim 12, wherein an included angle between the first tangent line and the second tangent line is between 3 degrees and 20 degrees.

14. The series-connected fan according to claim 10, wherein an inner periphery of the first hub comprises a curved portion, and an included angle between the axis and a tangent line of any point on the curved portion of the inner periphery in a plane containing the axis is between 0 degrees and 30 degrees.

15. The series-connected fan according to claim 10, wherein an inner periphery of the first hub comprises a curved portion, a third tangent line is defined on a start point of the curved portion of the inner periphery in a plane containing the axis, a fourth tangent line is defined on an end point of the curved portion of the inner periphery in the plane containing the axis, and an included angle between the axis and the fourth tangent line is greater than an included angle between the axis and the third tangent line.

16. The series-connected fan according to claim 15, wherein an included angle between the third tangent line and the fourth tangent line is between 3 degrees and 20 degrees.

17. The series-connected fan according to claim 1, wherein a rotation direction of the first impeller is opposite to a rotation direction of the second impeller.

* * * * *